US008325094B2

(12) United States Patent
Ayala Vazquez et al.

(10) Patent No.: US 8,325,094 B2
(45) Date of Patent: Dec. 4, 2012

(54) DIELECTRIC WINDOW ANTENNAS FOR ELECTRONIC DEVICES

(75) Inventors: Enrique Ayala Vazquez, Watsonville, CA (US); Gregory A. Springer, Sunnyvale, CA (US); Bing Chiang, Melbourne, FL (US); Douglas B. Kough, San Jose, CA (US); Robert W. Schlub, Campbell, CA (US); Yi Jiang, Cupertino, CA (US); Rodney Andres Gomez Angulo, Sunnyvale, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 688 days.

(21) Appl. No.: 12/486,496

(22) Filed: Jun. 17, 2009

(65) Prior Publication Data

US 2010/0321253 A1 Dec. 23, 2010

(51) Int. Cl.
*H01Q 1/24* (2006.01)

(52) U.S. Cl. ..... 343/702; 343/700 MS

(58) Field of Classification Search ..... 343/702, 343/700 MS, 767, 770
See application file for complete search history.

(56) References Cited

U.S. PATENT DOCUMENTS

| | | | | |
|---|---|---|---|---|
| 4,733,245 | A | 3/1988 | Mussler | |
| 6,181,284 | B1 * | 1/2001 | Madsen et al. | 343/702 |
| 6,225,959 | B1 | 5/2001 | Gordon | |
| 6,396,444 | B1 | 5/2002 | Goward et al. | |
| 6,667,719 | B2 | 12/2003 | LaKomski | |
| 6,759,986 | B1 | 7/2004 | Saliga et al. | |
| 6,894,650 | B2 | 5/2005 | Darden et al. | |
| 7,847,753 | B2 * | 12/2010 | Ishibashi et al. | 343/897 |
| 2003/0128165 | A1 * | 7/2003 | LaKomski | 343/702 |
| 2004/0085244 | A1 * | 5/2004 | Kadambi et al. | 343/700 MS |
| 2004/0227679 | A1 * | 11/2004 | Lu | 343/702 |
| 2006/0132362 | A1 * | 6/2006 | Yuanzhu | 343/700 MS |
| 2009/0153412 | A1 | 6/2009 | Chiang et al. | |

OTHER PUBLICATIONS

Ayala Vazquez et al., U.S. Appl. No. 12/553,944, filed Sep. 3, 2009.
Bevelacqua et al., U.S. Appl. No. 12/750,661, filed Mar. 30, 2010.
Shiu et al., U.S. Appl. No. 12/750,660, filed Mar. 30, 2010.
Chiang et al., U.S. Appl. No. 12/500,570, filed Jul. 9, 2009.
Chiang, U.S. Appl. No. 12/356,496, filed Jan. 20, 2009.
Chiang et al., U.S. Appl. No. 12/401,599, filed Mar. 10, 2009.
Guterman et al., U.S. Appl. No. 12/553,943, filed Sep. 3, 2009.
Vazquez et al, U.S. Appl. No. 12/238,384, filed Sep. 25, 2008.
Chiang et al., U.S. Appl. No. 11/959,306, filed Dec. 18, 2007.

* cited by examiner

*Primary Examiner* — Hoanganh Le
(74) *Attorney, Agent, or Firm* — Treyz Law Group; G. Victor Treyz; David C. Kellogg

(57) ABSTRACT

Logo antennas are provided for electronic devices such as portable computers. An electronic device may have a housing with conductive housing walls. A logo antenna may be formed from an antenna resonating element such as a patch antenna resonating element, a monopole antenna resonating element, or other antenna resonating element structure. A conductive cavity may be placed behind the antenna resonating element. A dielectric antenna window that serves as a logo may be used to cover the antenna resonating element. The dielectric antenna window may be mounted in an opening in the conductive housing walls. A positive antenna feed terminal may be coupled to the antenna resonating element. A ground antenna feed terminal may be coupled to the cavity and portions of the conductive housing walls. The dielectric antenna window may be shaped in the form of a logo.

11 Claims, 10 Drawing Sheets

DIELECTRIC WINDOW ANTENNAS FOR ELECTRONIC DEVICES

BACKGROUND

This relates generally to electronic device antennas, and, more particularly, to antennas for electronic devices with conductive housings.

Electronic devices such as portable computers and handheld electronic devices are becoming increasingly popular. Devices such as these are often provided with wireless communications capabilities. For example, electronic devices may use long-range wireless communications circuitry such as cellular telephone circuitry to communicate using cellular telephone bands at 850 MHz, 900 MHz, 1800 MHz, and 1900 MHz (e.g., the main Global System for Mobile Communications or GSM cellular telephone bands). Long-range wireless communications circuitry may also be used handle the 2100 MHz band and other bands. Electronic devices may use short-range wireless communications links to handle communications with nearby equipment. For example, electronic devices may communicate using the WiFi® (IEEE 802.11) bands at 2.4 GHz and 5 GHz (sometimes referred to as local area network bands) and the Bluetooth® band at 2.4 GHz.

It can be difficult to incorporate antennas successfully into an electronic device. Some electronic devices are manufactured with small form factors, so space for antennas is limited. Antenna operation can also be blocked by intervening metal structures. This can make it difficult to implement an antenna in an electronic device that contains conductive display structures, conductive housing walls, or other conductive structures that can potentially block radio-frequency signals.

It would therefore be desirable to be able to provide improved antennas for wireless electronic devices.

SUMMARY

Logo antennas are provided for electronic devices. An electronic device such as a portable computer or cellular telephone may be provided with a housing. The housing may contain conductive sidewalls. For example, the housing may be formed from a machined block of aluminum or other metals. The walls of the housing may be used to hold conductive components such as displays. Integrated circuits and other electronic components may be mounted within the housing.

A logo antenna may transmit and receive radio-frequency antenna signals through a dielectric window mounted in a housing wall. The logo antenna may have an antenna resonating element structure such as a patch antenna resonating element. The dielectric antenna window may serve as a logo. The dielectric antenna window may, for example, have the shape of a logo or may contain appropriate text or other visual logo attributes.

The logo antenna may be provided with a conductive antenna cavity. The cavity may have vertical sidewalls and a planar rear surface or may have other suitable cavity shapes. The antenna resonating element may be interposed between the dielectric antenna window and the antenna cavity. The antenna cavity may help isolate the logo antenna from the electronic components within the housing. With one suitable arrangement, the antenna cavity may be interposed between the antenna resonating element and the display, so that the rear wall of the antenna cavity lies parallel to the exposed planar face of the logo-shaped dielectric antenna window and the display.

Further features of the invention, its nature and various advantages will be more apparent from the accompanying drawings and the following detailed description of the preferred embodiments.

DETAILED DESCRIPTION

Figure 1:
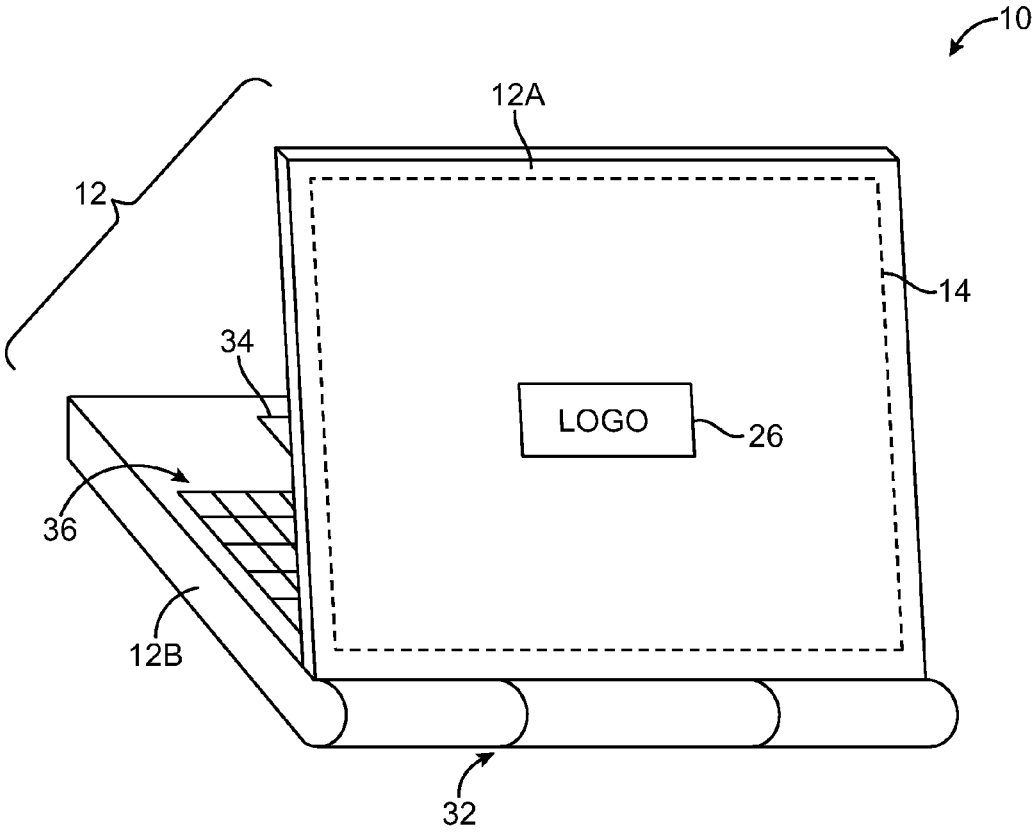
FIG. 1 is a perspective view of an illustrative electronic device with an antenna in accordance with an embodiment of the present invention.

Electronic devices may be provided with wireless communications circuitry. The wireless communications circuitry may be used to support wireless communications in one or more wireless communications bands. Antenna structures in an electronic device may be used in transmitting and receiving radio-frequency signals. The electronic device may have a conductive housing. For example, the electronic device may have a housing in which one or more portions are machined from blocks of aluminum or other metals. The metals may be coated with an insulating coating. For example, aluminum housing walls can be anodized. Electronic devices may also have components such as display screens that serve as relatively large planar conductive members. These components may be mounted within a housing such as a computer lid.

It can be difficult to successfully operate an antenna in an electronic device that is enclosed by conductive housing walls and conductive components such as displays. One or more of the housing walls may therefore be provided with a dielectric antenna window. To reduce visual clutter, it may be desirable to hide the antenna window in plain view, by forming the window from a dielectric logo structure. With this type of arrangement, a plastic logo may be mounted in a prominent location on an electronic device housing. Because the logo carries branding information or other information that is of interest to the user of the electronic device, the logo may serve a useful and accepted information-conveying purpose and need not introduce an undesirable visible design element to the exterior of the electronic device.

Antenna structures for the electronic device may be located under the plastic logo or other dielectric window. This allows the antenna structures to operate without being blocked by conductive housing walls or conducting components. In this type of configuration in which the antenna structures are blocked from view but can still operate by transmitting and receiving radio-frequency signals through the dielectric, the antenna structures may form antennas of a type that is sometimes referred to as a "logo antenna." Logo antennas may be used in environments in which other antenna mounting arrangements may be cumbersome, aesthetically unpleasing, or prone to interference due to the proximity of conductive housing walls or other conductive device structures that can block radio-frequency antenna signals.

Any suitable electronic devices may be provided with logo antennas. As an example, logo antennas may be formed in electronic devices such as desktop computers, portable computers such as laptop computers and tablet computers, in handheld electronic devices such as cellular telephones, etc. With one suitable configuration, which is sometimes described herein as an example, the logo antennas are formed in the housings of relatively compact electronic devices in which interior space can be valuable. The compact devices may be portable electronic devices.

Portable electronic devices that may be provided with logo antennas include laptop computers and small portable computers such as ultraportable computers, netbook computers, and tablet computers. Portable electronic devices may also be somewhat smaller devices. Examples of smaller portable electronic devices that may be provided with logo antennas include wrist-watch devices, pendant devices, headphone and earpiece devices, and other wearable and miniature devices. With one suitable arrangement, the portable electronic devices may be handheld electronic devices such as cellular telephones.

Space is at a premium in portable electronic devices and housings for these devices are sometimes constructed from conductive materials that block antenna signals. Arrangements in which antenna structures are formed behind a dielectric window such as a logo-shaped window can help address these challenges. For example, configurations in which a logo is placed in the center of the metal lid of a portable computer may be used. In this type of configuration, the logo antenna may be operated with relatively few obstructions both when the lid is in a closed position and in an open position. At the same time, the aesthetic appeal of the portable computer will not be disturbed, because users are accustomed to the presence of logos in prominent locations such as on computer lids. If the antenna were not located under the logo, the antenna might have to be located in an unobtrusive portion of the device to preserve desired aesthetics. This could compromise antenna operation.

Logo antennas can be mounted on any suitable exposed portion of a portable electronic device. For example, logo antennas can be provided on the front or top surface of the device. In a handheld device or other device in which the rear of the device may be exposed during operation, it may be acceptable to mount a logo antenna on the rear device surface. Other configurations are also possible (e.g., with logos mounted in more confined locations, on device sidewalls, etc.). The use of antenna logo mounting locations such as the top or rear surface is sometimes described herein as an example, but, in general, any suitable logo antenna mounting location may be used in an electronic device if desired.

Handheld devices that may be provided with logo antennas include cellular telephones, media players with wireless communications capabilities, handheld computers (also sometimes called personal digital assistants), remote controllers, global positioning system (GPS) devices, and handheld gaming devices. Handheld devices and other portable devices may include the functionality of multiple conventional devices. As an example, a handheld device with cellular telephone functions may include computing equipment resources that allow the handheld device to run games, media player applications, web browsers, productivity software, and other code.

An illustrative portable device such as a portable computer that may include a logo antenna is shown in FIG. 1. As shown in FIG. 1, device 10 may be a portable computer having a housing such as housing 12. Housing 12 may have an upper portion such as upper housing 12A, which is sometimes referred to as the lid or cover. Housing 12 may also have a lower portion such as lower housing 12B, which is sometimes referred to as the housing base or main unit. Housing portions 12A and 12B may be pivotably attached to each other using a hinge structure such as hinge 32 (sometimes referred to as a clutch barrel hinge). A display may be mounted to the inner surface of upper housing 12A, as indicated by dashed lines 14. Other components such as keyboard 36 and touch pad 34 may be mounted in lower housing 12B.

Housing 12, which is sometimes referred to as a case, may be formed of any suitable materials including, plastic, wood, glass, ceramics, metal, or other suitable materials, or a combination of these materials. In some situations, portions of housing 12 may be a dielectric or other low-conductivity material, so that the operation of conductive antenna elements that are located in proximity to housing 12 are not disrupted. In other situations, housing 12 may be formed from metal elements. An advantage of forming housing 12 from metal or other structurally sound conductive materials is that this may improve device aesthetics and may help improve durability and portability.

Particularly in configurations for device 10 in which some or all of housing 12 is formed from conductive materials, it may be advantageous to form an antenna for device 10 using a logo antenna arrangement. With this type of configuration, one or more of the antennas for device 10 may be hidden from view behind a dielectric antenna window that serves as a logo. In the example of FIG. 1, device 10 has logo antenna 26 on housing portion 12A. Logo antennas such as the illustrative logo antenna of FIG. 1 may be mounted in prominent locations within device 10, because users of device 10 are accustomed to prominently located logos. With the illustrative prominent mounting location for logo antenna 26 of FIG. 1, logo antenna 26 is mounted in a central portion of the exterior surface of upper housing portion 12A (i.e., in roughly the middle of the top surface of the computer lid). Other mounting locations may be used if desired (e.g., on the side or rear of device 10, on an interior surface, such as a surface adjacent to keys 36, etc.).

Figure 2A:
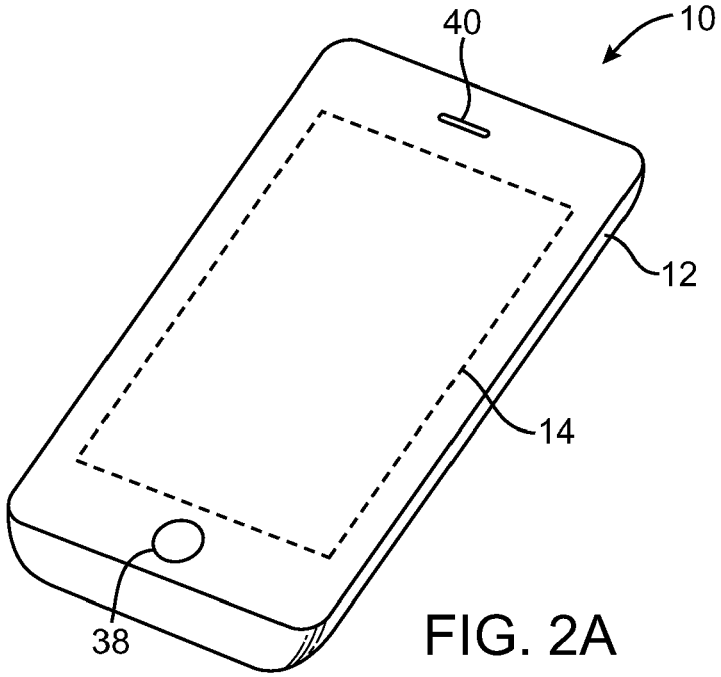
FIGS. 2A and 2B are respective front and rear perspective views of another illustrative electronic device with an antenna in accordance with an embodiment of the present invention.
Figure 2B:
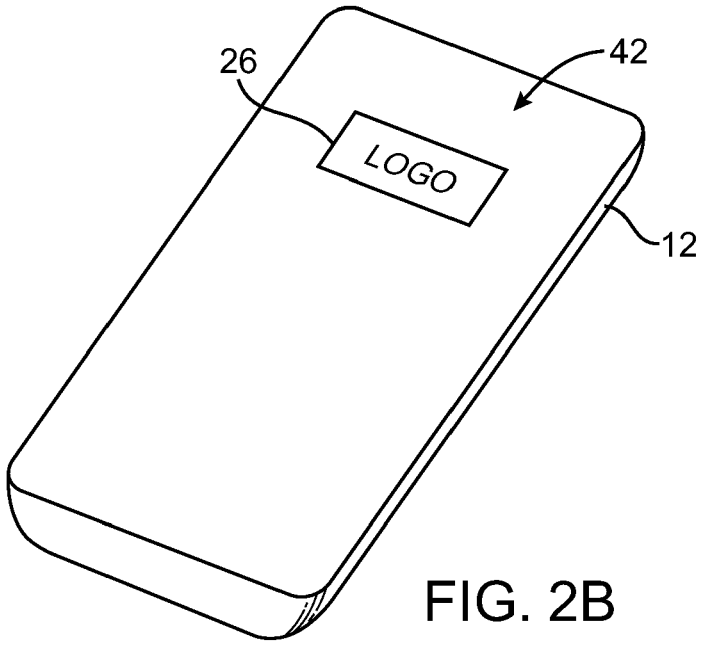

Another illustrative electronic device is shown in FIGS. 2A and 2B. In the example of FIGS. 2A and 2B, device 10 is a handheld electronic device such as a handheld device with cellular telephone capabilities. As shown in FIG. 2A, device 10 may have a housing 12. Housing 12 may be formed from plastic, metal, other suitable dielectric materials, other suitable conductive materials, or combinations of such materials. A display such as display 14 may be provided on the front face of device 10. Display 14 of FIG. 2A may be a touch screen display (as an example). Device 10 may have a speaker port 40 and other input-output ports. One or more buttons such as button 38 and other user input devices may be used to gather user input. As shown in FIG. 2B, logo antenna 26 may be provided on rear surface 42 of device 10 (as an example). Housing 12 of device 10 in FIG. 2B may be formed from a conductive material or there may be circuit boards and other conductive components in device 10 that block radio-frequency antenna signals. By providing a dielectric window such as a dielectric logo-shaped window associated with logo antenna 26 of FIG. 2B, logo antenna 26 may operate without being blocked by these conductive structures.

Figure 3:
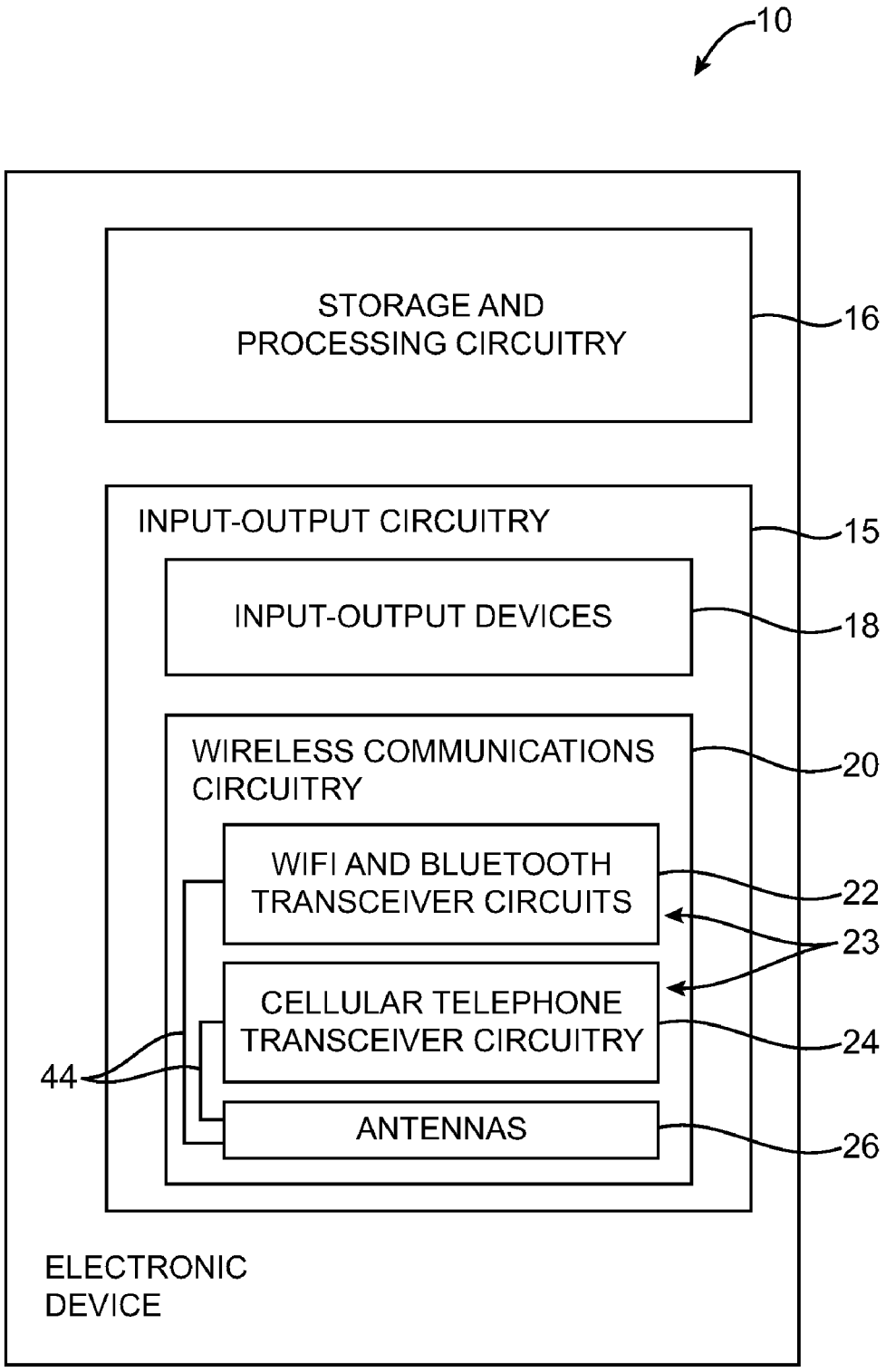
FIG. 3 is a schematic diagram of an illustrative electronic device with antenna structures in accordance with an embodiment of the present invention.

A schematic diagram of device 10 showing how device 10 may include one or more logo antennas 26 and transceiver circuits that communicate with logo antennas 26 is shown in FIG. 3. Electronic device 10 of FIG. 3 may be a portable computer such as a laptop computer, a portable tablet computer, a mobile telephone, a mobile telephone with media player capabilities, a handheld computer, a remote control, a game player, a global positioning system (GPS) device, a desktop computer, a combination of such devices, or any other suitable electronic device.

As shown in FIG. 3, electronic device 10 may include storage and processing circuitry 16. Storage and processing circuitry 16 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 16 may be used to control the operation of device 10. Processing circuitry 16 may be based on a processor such as a microprocessor and other suitable integrated circuits. With one suitable arrangement, storage and processing circuitry 16 may be used to run software on device 10, such as internet browsing applications, voice-over-internet-protocol (VOIP) telephone call applications, email applications, media playback applications, operating system functions, etc. Storage and processing circuitry 16 may be used in implementing suitable communications protocols. Communications protocols that may be implemented using storage and processing circuitry 16 include internet protocols, wireless local area network protocols (e.g., IEEE 802.11 protocols—sometimes referred to as WiFi®), protocols for other short-range wireless communications links such as the Bluetooth® protocol, etc.

Input-output circuitry 14 may be used to allow data to be supplied to device 10 and to allow data to be provided from device 10 to external devices. Input-output devices 18 such as touch screens and other user input interface are examples of input-output circuitry 14. Input-output devices 18 may also include user input-output devices such as buttons, joysticks, click wheels, scrolling wheels, touch pads, key pads, keyboards, microphones, cameras, etc. A user can control the operation of device 10 by supplying commands through such user input devices. Display and audio devices may be included in devices 18 such as liquid-crystal display (LCD) screens, light-emitting diodes (LEDs), organic light-emitting diodes (OLEDs), and other components that present visual information and status data. Display and audio components in input-output devices 18 may also include audio equipment such as speakers and other devices for creating sound. If desired, input-output devices 18 may contain audio-video interface equipment such as jacks and other connectors for external headphones and monitors.

Wireless communications circuitry 20 may include radio-frequency (RF) transceiver circuitry 23 formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 20 may include radio-frequency transceiver circuits for handling multiple radio-frequency communications bands. For example, circuitry 20 may include transceiver circuitry 22 that handles 2.4 GHz and 5 GHz bands for WiFi (IEEE 802.11) communications and the 2.4 GHz Bluetooth communications band. Circuitry 20 may also include cellular telephone transceiver circuitry 24 for handling wireless communications in cellular telephone bands such as the GSM bands at 850 MHz, 900 MHz, 1800 MHz, and 1900 MHz, and the 2100 MHz data band (as examples). Wireless communications circuitry 20 can include circuitry for other short-range and long-range wireless links if desired. For example, wireless communications circuitry 20 may include global positioning system (GPS) receiver equipment, wireless circuitry for receiving radio and television signals, paging circuits, etc. In WiFi and Bluetooth links and other short-range wireless links, wireless signals are typically used to convey data over tens or hundreds of feet. In cellular telephone links and other long-range links, wireless signals are typically used to convey data over thousands of feet or miles.

Wireless communications circuitry 20 may include antennas 26. Some or all of antennas 26 may be logo antennas such as logo antenna 26 of FIG. 1 and logo antenna 26 of FIG. 2B. Logo antennas 26 may be single band antennas that each cover a particular desired communications band or may be multiband antennas. A multiband antenna may be used, for example, to cover multiple cellular telephone communications bands. If desired, a dual band logo antenna may be used to cover two WiFi bands (e.g., 2.4 GHz and 5 GHz). Different types of antennas may be used for different bands and combinations of bands. For example, it may be desirable to form a dual band antenna for forming a local wireless link antenna, a multiband antenna for handling cellular telephone communications bands, and a single band antenna for forming a global positioning system antenna (as examples).

Paths 44 such as transmission line paths may be used to convey radio-frequency signals between transceivers 22 and 24 and antennas 26. Radio-frequency transceivers such as radio-frequency transceivers 22 and 24 may be implemented using one or more integrated circuits and associated components (e.g., switching circuits, matching network components such as discrete inductors, capacitors, and resistors, and integrated circuit filter networks, etc.). These devices may be mounted on any suitable mounting structures. With one suitable arrangement, transceiver integrated circuits may be mounted on a printed circuit board. Paths 44 may be used to interconnect the transceiver integrated circuits and other components on the printed circuit board with logo antenna structures in device 10. Paths 44 may include any suitable conductive pathways over which radio-frequency signals may be conveyed including transmission line path structures such as coaxial cables, microstrip transmission lines, etc.

Logo antennas 26 may, in general, be formed using any suitable antenna types. Examples of suitable antenna types for logo antennas 26 include antennas with resonating elements that are formed from patch antenna structures, inverted-F antenna structures, closed and open slot antenna structures, loop antenna structures, monopoles, dipoles, planar inverted-F antenna structures, hybrids of these designs, etc. All or part of a logo antenna may be formed from a conductive portion of housing 12. For example, housing 12 or a part of housing 12 may serve as a conductive ground plane for a logo antenna. Conductive cavities may be provided for a logo antenna (e.g., to form a cavity-backed antenna design).

Figure 4:
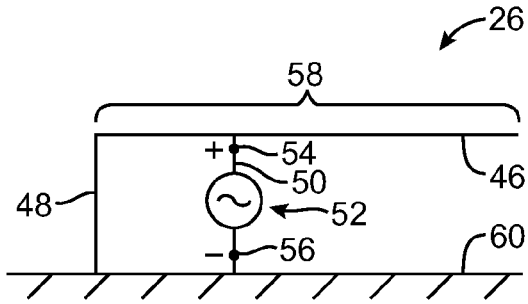
FIG. 4 is a top view of an illustrative inverted-F antenna resonating element for a logo antenna in accordance with an embodiment of the present invention.

Illustrative antenna structures that may be used in forming a logo antenna for device 10 include inverted-F antenna structures such as the inverted-F antenna structure of FIG. 4. Antenna 26 of FIG. 4 may be fed by radio-frequency source 52 at positive antenna feed terminal 54 and ground antenna feed terminal 56. Positive antenna feed terminal 54 may be coupled to antenna resonating element 58. Ground antenna feed terminal 56 may be coupled to ground element 60. Resonating element 58 may have a main arm 46 and a shorting branch 48 that connects main arm 46 to ground 60.

Figure 5:
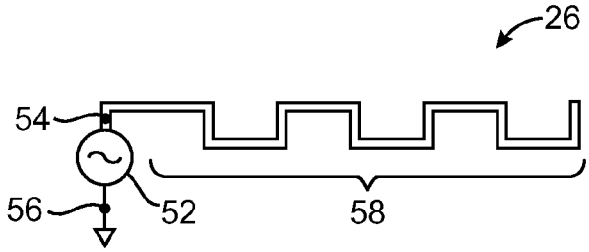
FIG. 5 is a top view of an illustrative monopole antenna resonating element for a logo antenna in accordance with an embodiment of the present invention.

FIG. 5 shows an illustrative arrangement for logo antenna 26 that is based on a monopole antenna configuration. In the example of FIG. 5, resonating element 58 of antenna 26 has a meandering serpentine path shape. Feed terminal 54 may be connected to one end of resonating element 58. Ground feed terminal 56 may be coupled to housing 12 or another suitable ground plane element.

Figure 6:
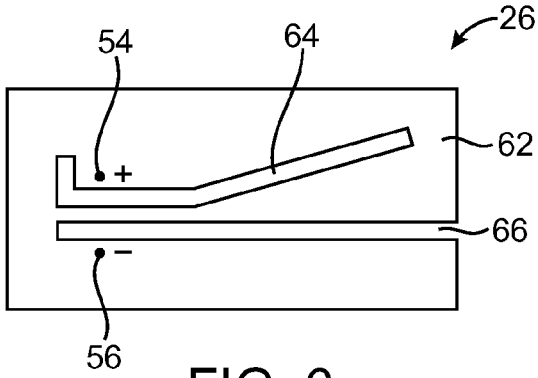
FIG. 6 is a top view of an illustrative slot antenna resonating element for a logo antenna in accordance with an embodiment of the present invention.

In the example of FIG. 6, conductive antenna structures 62 are configured to define a closed slot 64 and an open slot 66. The antenna formed from structures 62 of FIG. 6 may be fed using positive antenna feed terminal 54 and ground antenna feed terminal 56. In this type of arrangement, slots 64 and 66 serve as antenna resonating elements for antenna 26. The sizes of slots 64 and 66 may be configured so that antenna 26 operates in desired communications bands (e.g., 2.4 GHz and 5 GHz, etc.).

Figure 7:
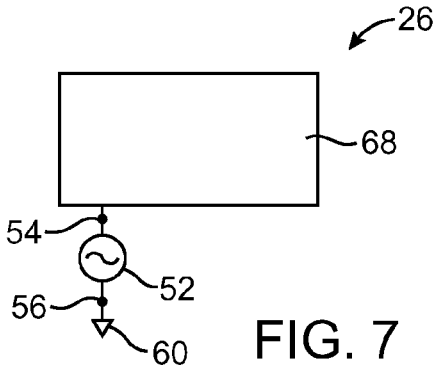
FIG. 7 is a top view of an illustrative patch antenna resonating element for a logo antenna in accordance with an embodiment of the present invention.

Another possible configuration for logo antenna 26 is shown in FIG. 7. In the arrangement of FIG. 7, antenna 26 has a patch antenna resonating element 68. Antenna 26 of FIG. 7 may be fed using positive antenna feed terminal 54 and ground antenna feed terminal 56. Ground 60 may be associated with housing 12 or other suitable ground plane elements in device 10.

Figure 8:
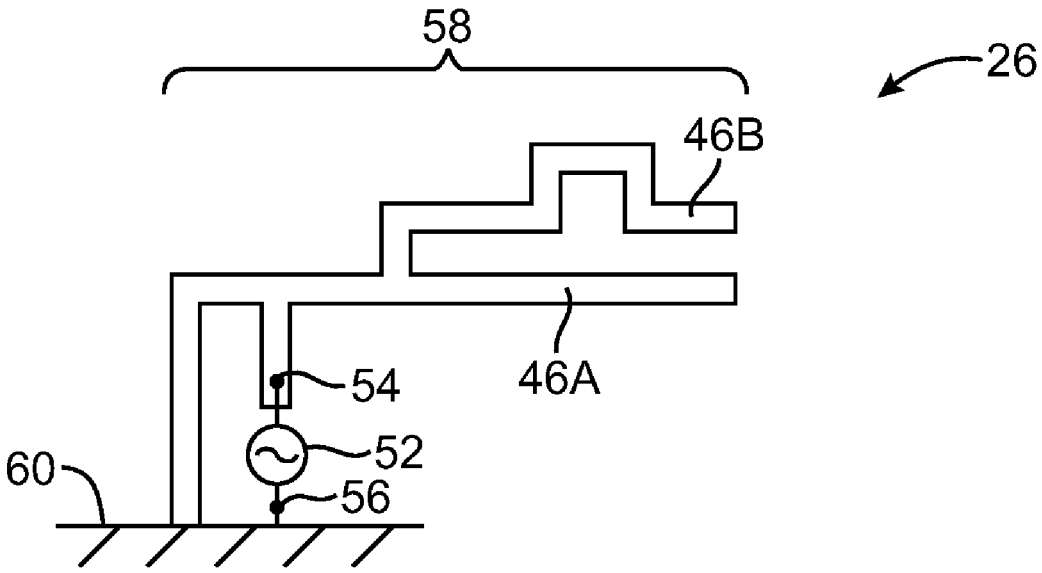
FIG. 8 is a top view of an illustrative multibranch inverted-F antenna resonating element for a logo antenna in accordance with an embodiment of the present invention.

FIG. 8 shows another illustrative configuration that may be used for the antenna structures of logo antenna 26. In the FIG. 8 example, antenna resonating element 58 has two main arms. Arm 46A is shorter than arm 46B and is therefore associated with higher frequencies of operation than arm 46A. By using two or more separate resonating element structures of different sizes, antenna resonating element 58 can be configured to cover a wider bandwidth or more than a single communications band of interest.

Antenna resonating elements and other logo antenna structures in device 10 may be formed from any suitable conductive structures. For example, antenna structures can be formed from conductive traces on flexible and rigid printed circuit boards. Rigid printed circuit boards may be formed from a dielectric substrate such as epoxy (e.g., a fiberglass-filled epoxy substrate such as FR4). Flexible printed circuits boards ("flex circuits") may be formed from polymer films such as polyimide films. Antenna structures may also be formed from conductive layers on plastic support structures, machined or stamped metal parts, metal foil, wires, or other suitable conductive structures. Antenna resonating elements may be formed from structures that are separate from the dielectric antenna window or may be formed as part of the dielectric antenna window (e.g., by forming conductive traces on the underside of the window). When forming antenna resonating elements from separate structures such as printed circuit board structures, the resonating elements may be attached to the dielectric window or other portions of device 10 using adhesive, fasteners, or other suitable mounting structures.

If desired, antenna structures of the type shown in FIGS. 4, 5, 6, 7, and 8, and other antenna structures for logo antenna 26 may be backed by a conductive antenna cavity. In a typical cavity antenna configuration, the antenna cavity is grounded and serves to reflect and direct antenna signals away from the cavity. For use with logo antenna 26, for example, a cavity may be placed beneath the dielectric logo structure and associated antenna resonating element to direct antenna signals through the dielectric logo and into free space. This type of configuration may improve antenna efficiency and may help isolate internal electrical components in device 10 from the antenna, thereby reducing potential electromagnetic interference.

Figure 9:
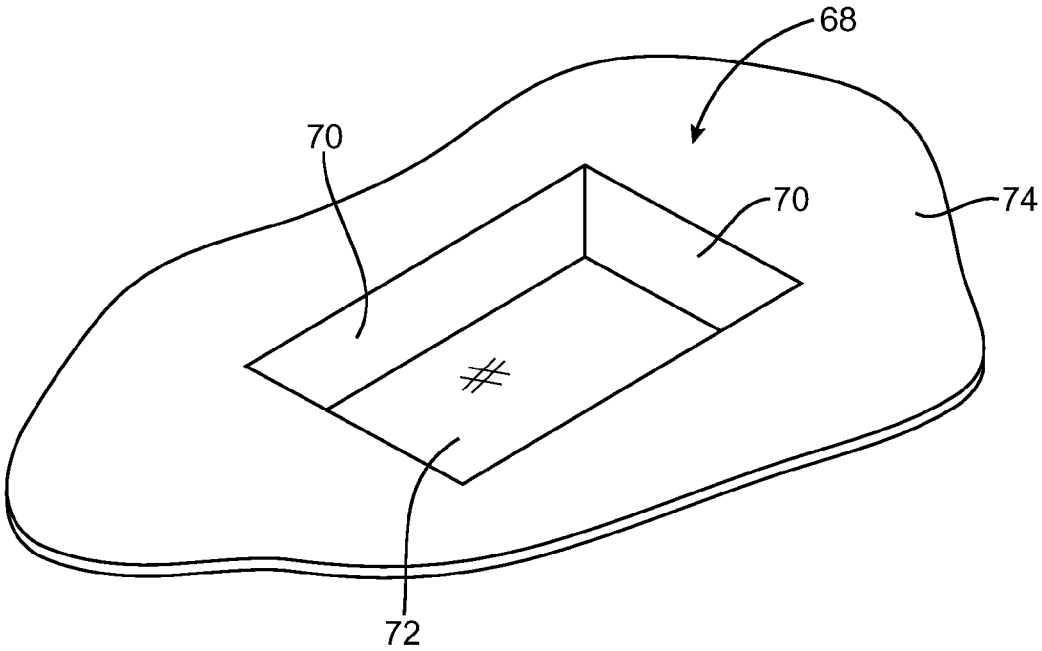
FIG. 9 is a perspective view of an illustrative antenna cavity for a logo antenna in accordance with an embodiment of the present invention.

An illustrative antenna cavity for logo antenna 26 is shown in FIG. 9. In the example of FIG. 9, cavity 68 has a substantially rectangular aperture in the exterior surface of conductive structures 74, conductive vertical sidewalls 70, and conductive planar lower surface 72. Conductive cavity structures 74 and the structures that make up cavity surfaces such as walls 70 and 72 can be formed from portions of a conductive housing 12 (e.g., portions of metal housing walls), portions of printed circuit boards, stamped metal parts, metal traces on plastic supports, separately machined metal structures, or any other suitable conductive members. Although the illustrative configuration of cavity 68 of FIG. 9 is rectangular, antenna cavities such as cavity 68 may, in general, have any suitable shape. For example, a cavity for a cavity-backed logo antenna may have straight sidewalls, curved sidewalls, a planar lower wall surface, a curved lower surface, a circular or oval surface opening, other nonrectangular surface opening shapes, combinations of these feature shapes, or cavity structures of other suitable shapes.

A logo antenna may be formed behind a dielectric window of any suitable configuration. As an example, a logo antenna may be formed from a circular dielectric window structure such as dielectric window 76 of FIG. 10.

Figure 10:
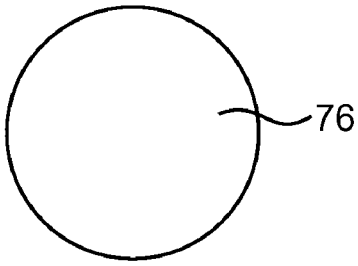
FIG. 10 is a top view of an illustrative circular dielectric antenna window for a logo antenna in accordance with an embodiment of the present invention.
Figure 11:
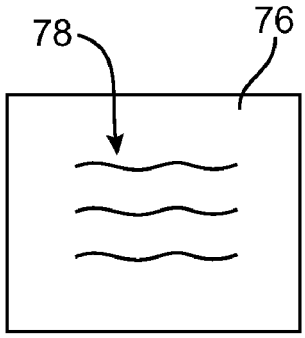
FIG. 11 is a top view of an illustrative rectangular dielectric antenna window for a logo antenna in accordance with an embodiment of the present invention.
Figure 12:
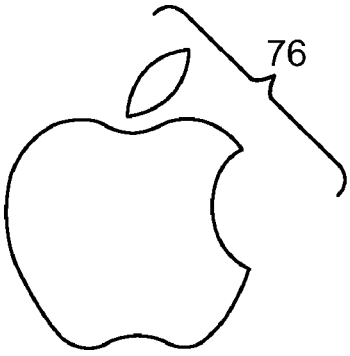
FIG. 12 is a top view of an illustrative logo-shaped dielectric antenna window for a logo antenna in accordance with an embodiment of the present invention.

As shown by rectangular dielectric window structure 76 of FIG. 11, dielectric window structures for logo antenna 26 may be rectangular or may have other non-circular shapes. If desired, structures such as window structure 76 of FIG. 10 and window structure 76 of FIG. 11 may be provided with colored regions, text, graphics, surface texture, or other features that allow window structure 76 to convey visual information to a user. This information, which is shown schematically by lines 78 in FIG. 11, may include brand name information, promotional text, product information, product type information, or other promotional information. As an example, information 78 may include a company name, a product name, a trademark, a personalized message, or other suitable visual indicator that conveys information of promotional value or other value to a user of device 10. In a typical scenario, device 10 may be a portable computer, and dielectric window 76 may include information 78 such as the name of the manufacturer of the portable computer. Sometimes logos can convey this information without text or by using a logo shape in combination with text, graphics, colors, etc. In the example of FIG. 12, dielectric window 76 is a logo-shaped dielectric window having the trademark shape of a well known manufacturer of computers (Apple Inc. of Cupertino, Calif.). These are merely illustrative examples. Logo antenna 26 may have any suitable dielectric logo structure that serves as a dielectric antenna window.

Dielectric window structures such as dielectric window structures 76 of FIGS. 10, 11, and 12 may be formed over antenna structures such as the structures of FIGS. 4, 5, 6, 7, and 8, with or without cavities of the type shown in FIG. 9 or other suitable antenna structures. The size of logo structures 76 may be selected to cover some or all of the underlying antenna (i.e., the "footprint" of dielectric window structure 76 may be matched to the underlying antenna size and shape). There need not be a perfect match between the size and shape of dielectric window structure 76 and the underlying antenna structures in a given logo antenna. For example, dielectric window structure 76 may be somewhat larger or somewhat smaller in area than the underlying antenna resonating element structures and/or antenna cavity in logo antenna 26.

Antenna dielectric window structure 76 may be formed from any suitable dielectric that is transparent to radio-frequency signals in the communications bands of interest for logo antenna 26. For example, antenna dielectric window structure 76 may be formed using plastics such as acrylonitrile butadiene styrene (ABS) plastic, polycarbonate, epoxy, polyimide, other suitable polymer materials, ceramic, glass, wood, structures that incorporate small amounts of conductive materials into a dielectric (e.g., for visual impact), etc.

Figure 13:
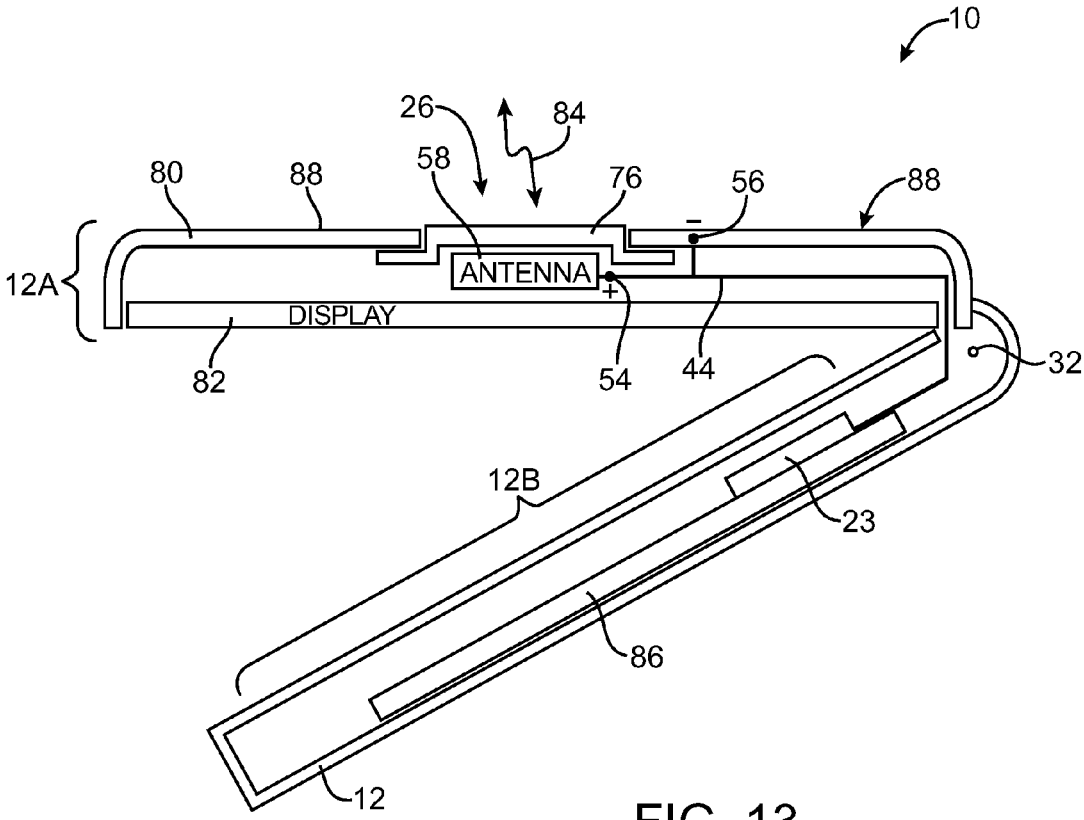
FIG. 13 is a cross-sectional side view of an electronic device such as a portable computer that has a logo antenna in accordance with an embodiment of the present invention.

A cross-sectional side view of an illustrative electronic device with a logo antenna is shown in FIG. 13. Electronic device 10 of FIG. 13 may be, for example, a portable computer. As shown in FIG. 13, electronic device 10 may have an upper housing 12A and a lower housing 12B. Upper housing 12A and lower housing 12B may be pivotably connected by hinge 32. If desired, device 10 may be a tablet computer without hinged housing portions. The example of FIG. 13 is merely illustrative.

Upper housing 12A may have a metal housing wall 80 that covers the top surface of the lid for electronic device 10. Housing walls for device 10 may be formed from machined aluminum, other metals, other conductive materials, etc. Display 82 may be mounted to the front portion of upper housing 12A. Display 82 may be, for example, a liquid crystal display (LCD). Display 82 may contain electrodes and other conductive structures that cause display 82 to act as a planar conductive member. Display 82 and housing wall 88 may therefore block passage of radio-frequency antenna signals.

Logo antenna 26 may include an antenna resonating element such as antenna resonating elements 58 of FIGS. 4, 5, 6, 7, and 8 or other suitable antenna resonating element structures. Dielectric window 76 is transparent to radio-frequency signals and may therefore allow radio-frequency signals 84 to be received by antenna 26 from external sources and to be transmitted by antenna 26 to external sources. Portions of conductive housing wall 80 and other conductive structures in device 10 may be connected to antenna ground feed terminal 56 and may serve as antenna ground for antenna 26. Positive antenna feed terminal 54 and ground antenna feed terminal 56 may be coupled to a radio-frequency transceiver circuit such as radio-frequency transceiver circuitry 23 in lower housing portion 12B using transmission line 44 (e.g., a coaxial cable, a flex circuit transmission line, etc.). Radio-frequency transceiver circuitry 23 may be mounted on one or more printed circuit boards in housing 12B such as printed circuit board 86.

Figure 14:
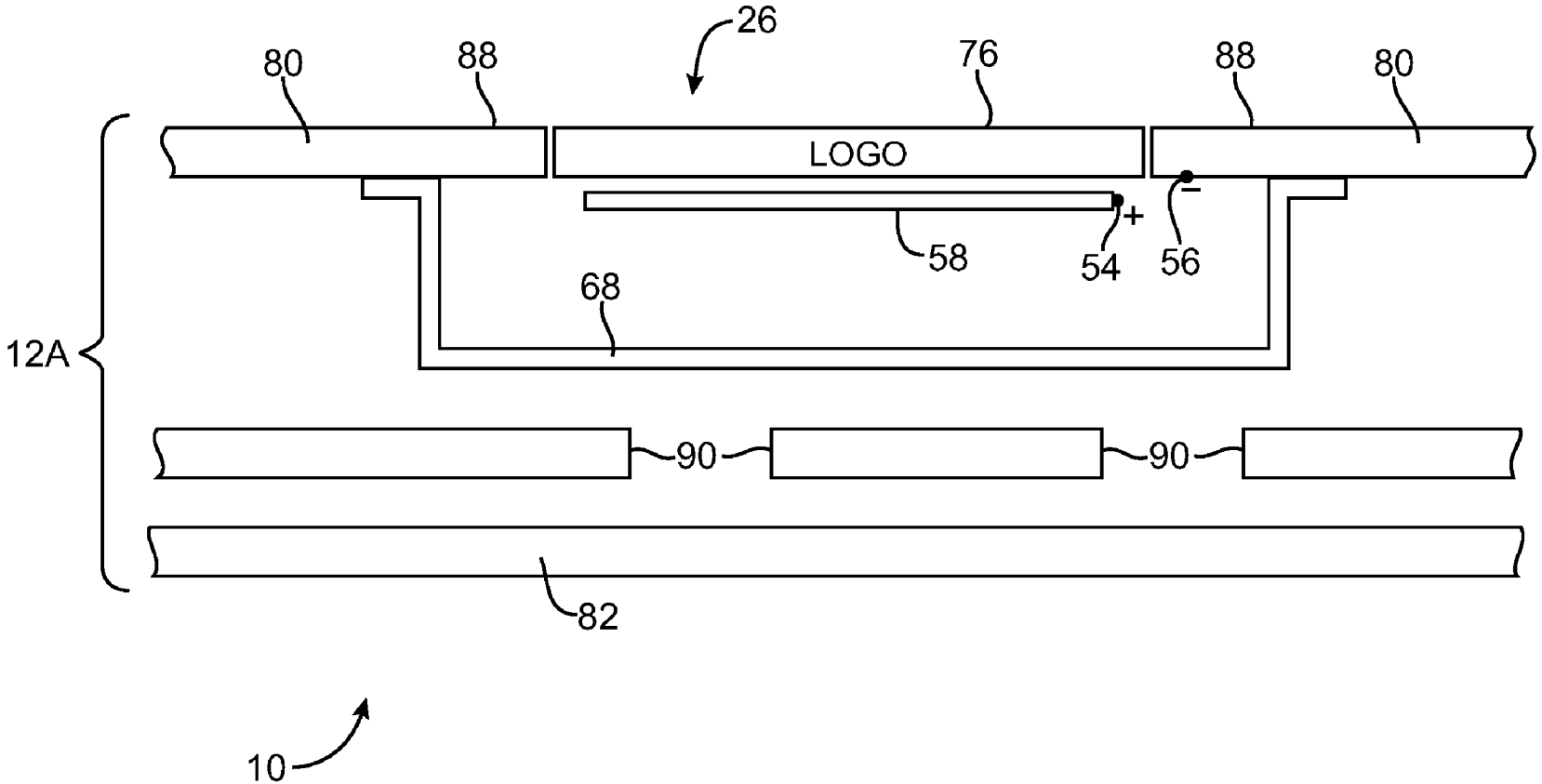
FIG. 14 is a cross-sectional side view of a portion of an electronic device such as a portable computer that has a logo antenna in accordance with an embodiment of the present invention.

A cross-sectional side view of an illustrative configuration for a cavity-backed logo antenna is shown in FIG. 14. As shown in FIG. 14, logo antenna 26 may have a dielectric logo window 76 and antenna resonating element 58. Antenna ground structures for antenna 26 may be formed from portions of conductive housing wall 80 in upper housing 12A. These structures or other suitable ground structures may be shorted to antenna cavity 68. Cavity 68 may, for example, be a metal rectangular cavity of the type shown in FIG. 9. Housing portion 12A may be used to mount display 82 and other electrical components for device 10 (shown schematically as electrical components 90). Potential electromagnetic interference between logo antenna 26 and components 90 and 82 may be reduced by the presence of antenna cavity 68. Antenna cavity 68 may also help to improve the efficiency of logo antenna 26.

Figure 15:
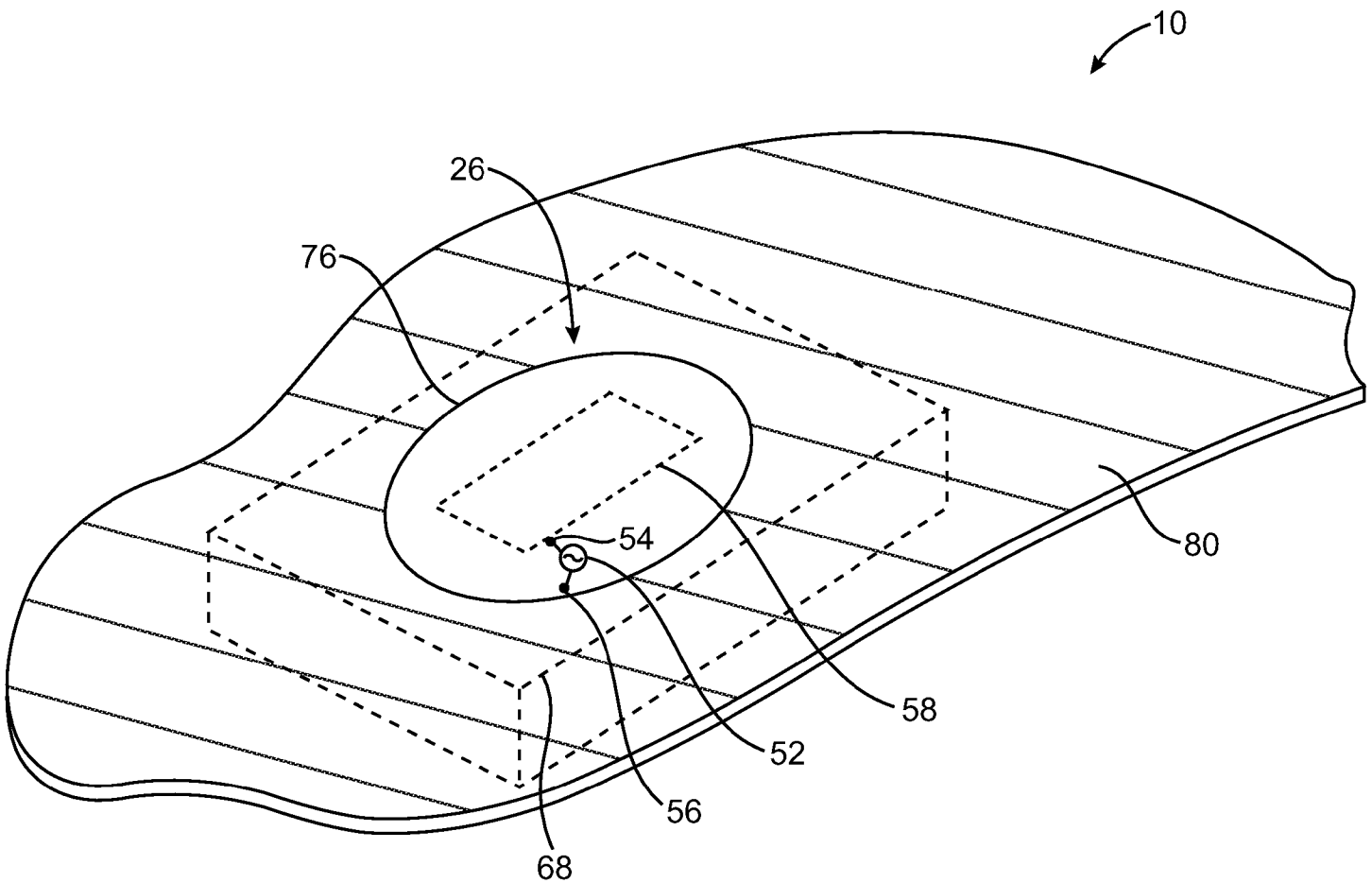
FIG. 15 is a perspective view of a portion of an electronic device such as a portable computer that has a logo antenna in accordance with an embodiment of the present invention.

A perspective view of an illustrative logo antenna in an electronic device is shown in FIG. 15. As shown in FIG. 15, electronic device 10 may have housing structures such as conductive housing wall 80. Dielectric window 76 (which is circular in the FIG. 15 example) may be disposed over antenna resonating element 58 (e.g., a rectangular patch antenna in this example) to cover element 58 from view. Antenna 26 may be fed using antenna feed terminals 54 and 56. Portions of housing wall 80 may serve as antenna ground and may, with antenna cavity 68, be shorted to antenna ground feed terminal 56.

The foregoing is merely illustrative of the principles of this invention and various modifications can be made by those skilled in the art without departing from the scope and spirit of the invention.

What is claimed is:

1. A portable computer with a logo antenna, comprising:

a lid;

a base pivotably connected to the lid;

a metal housing wall that forms a top surface for the lid;

a dielectric logo structure in the metal housing wall that serves as a dielectric antenna window for the logo antenna;

an antenna resonating element for the logo antenna that is mounted behind the dielectric logo structure, so that radio-frequency antenna signals pass from the antenna resonating element through the dielectric logo structure;

a ground antenna terminal connected to the metal housing wall.

2. The portable computer defined in claim 1 wherein the dielectric logo structure contains text.

3. The portable computer defined in claim 2 wherein the dielectric logo structure comprises a planar plastic member.

4. The portable computer defined in claim 1 wherein the dielectric logo structure comprises a logo-shaped plastic member.

5. The portable computer defined in claim 1 further comprising a conductive antenna cavity for the logo antenna that is mounted behind the antenna resonating element.

6. The portable computer defined in claim 5 wherein the antenna resonating element comprises a patch antenna resonating element.

7. A logo antenna, comprising:

metal antenna ground structures having a ground antenna feed terminal, wherein the metal antenna ground structures comprises metal housing walls in an electronic device;

an inverted-F antenna resonating element having first and second arms and having a positive antenna feed terminal; and a logo-shaped dielectric antenna window that covers least part of the antenna resonating element.

8. The logo antenna defined in claim 7 wherein the logo-shaped dielectric antenna window comprises plastic.

9. The logo antenna defined in claim 7 wherein the metal antenna ground structures include an antenna cavity.

10. The logo antenna defined in claim 7 wherein:

a first portion of the metal antenna ground structures comprise the metal housing walls;

a second portion of the conductive antenna ground structures comprise a metal antenna cavity; and the inverted-F antenna resonating element is interposed between the metal antenna cavity and the logo-shaped dielectric antenna window.

11. The logo antenna defined in claim 10 wherein the metal antenna cavity comprises a rectangular metal cavity with vertical sidewalls and a planar rear wall structure that lies parallel to the logo-shaped dielectric antenna window.

* * * * *